US008365323B2

(12) United States Patent
Crumrine

(10) Patent No.: US 8,365,323 B2
(45) Date of Patent: Feb. 5, 2013

(54) INFLATABLE, PORTABLE CRIB

(75) Inventor: Scott Crumrine, San Marino, CA (US)

(73) Assignee: Guava Family, Inc., San Diego, CA (US)

( * ) Notice: Subject to any disclaimer, the term of this patent is extended or adjusted under 35 U.S.C. 154(b) by 384 days.

(21) Appl. No.: 12/488,495

(22) Filed: Jun. 19, 2009

(65) Prior Publication Data

US 2010/0319122 A1 Dec. 23, 2010

(51) Int. Cl.
*A47C 7/00* (2006.01)

(52) U.S. Cl. ..... 5/99.1; 5/93.1; 5/98.1; 5/655; 5/945; 52/2.11

(58) Field of Classification Search ..... 5/93.1, 5/99.1, 98.1, 655, 425, 945; 52/2.11, 22
See application file for complete search history.

(56) References Cited

U.S. PATENT DOCUMENTS 3,323,147 A * 6/1967 Van Dean ..... 5/98.1
3,430,271 A * 3/1969 Junod-Deile ..... 5/93.1
3,457,684 A * 7/1969 Wood, Jr. ..... 52/2.21
3,619,825 A * 11/1971 Taub et al. ..... 5/945
3,763,506 A * 10/1973 Szego ..... 5/93.1
3,833,947 A * 9/1974 Sorensen ..... 5/94
4,003,098 A * 1/1977 Fink ..... 5/93.1
4,104,750 A * 8/1978 Kelter et al. ..... 5/93.1
D276,384 S * 11/1984 Kroll ..... D6/390
4,651,367 A 3/1987 Osher et al.
4,670,923 A * 6/1987 Gabriel et al. ..... 5/655
4,815,153 A * 3/1989 Bleser et al. ..... 5/98.1
4,819,284 A * 4/1989 Brown ..... 5/98.1
4,819,285 A 4/1989 Fetters
4,827,542 A * 5/1989 Kurtenbach ..... 5/93.1
4,980,937 A * 1/1991 Mason et al. ..... 5/655
D315,838 S * 4/1991 Penrod ..... 5/944
D344,642 S * 3/1994 Artz ..... D6/390
5,291,623 A * 3/1994 Artz ..... 5/93.1
5,341,530 A * 8/1994 Ward ..... 5/93.1
5,345,622 A * 9/1994 Plone ..... 5/945
D364,977 S * 12/1995 Hine ..... D6/391
5,761,852 A * 6/1998 Liu ..... 52/2.13
5,970,539 A 10/1999 McDermott et al.
6,109,280 A * 8/2000 Custer ..... 5/97
6,152,530 A 11/2000 Hsu et al.
6,192,633 B1 * 2/2001 Hilbert ..... 52/2.18
6,325,086 B1 * 12/2001 Shinner et al. ..... 135/126
6,357,462 B1 * 3/2002 Laosunthara et al. ..... 5/99.1
6,588,028 B1 * 7/2003 Wu ..... 4/506

(Continued)

OTHER PUBLICATIONS

PCT Application PCT/US2010/039393 International Search Report mailed Jan. 28, 2011.

*Primary Examiner* — Robert G Santos
*Assistant Examiner* — Brittany Wilson
(74) *Attorney, Agent, or Firm* — Cooley LLP

(57) ABSTRACT

The instant invention is an inflatable, portable crib, comprising: a bottom most member parallel to the floor, at least one vertical member operationally connected to said bottom most member, at least three struts arranged around the perimeter of the bottom most member, and at least one horizontal member, said horizontal member(s) connecting at least two struts toward the tops of the struts, and said horizontal member(s) operationally connected to said vertical member(s), wherein said vertical member(s) and said bottom most member create an enclosed space; and wherein said struts and horizontal member(s) consist of an outer shell of dimensionally stable material and at least one inner bladder; and when said inner bladder(s) are inflated with air under pressure, said struts and vertical member(s) create a rigid structure for supporting said enclosed space.

36 Claims, 6 Drawing Sheets

U.S. PATENT DOCUMENTS

| | | | | |
|---|---|---|---|---|
| 6,651,275 | B1 | 11/2003 | Rummell | |
| 6,679,811 | B2 * | 1/2004 | Chen | 482/29 |
| 6,799,338 | B1 * | 10/2004 | Hsia | 5/93.1 |
| 7,131,701 | B1 | 11/2006 | Yang | |
| 7,246,393 | B2 | 7/2007 | Westendorf et al. | |
| D607,220 | S * | 1/2010 | Hardy et al. | D6/331 |
| 7,661,157 | B2 * | 2/2010 | McCluskey et al. | 5/99.1 |
| 2002/0183166 | A1 * | 12/2002 | Chen | 482/29 |
| 2003/0196263 | A1 * | 10/2003 | Hardy | 5/93.1 |
| 2004/0050411 | A1 * | 3/2004 | Lawrence | 135/128 |
| 2005/0172400 | A1 * | 8/2005 | Hardy | 5/93.1 |
| 2006/0236461 | A1 * | 10/2006 | Ryan | 5/655 |
| 2007/0061962 | A1 | 3/2007 | Pascual | |
| 2007/0271854 | A1 * | 11/2007 | Wiegand et al. | 52/2.11 |
| 2010/0159796 | A1 * | 6/2010 | Chiang | 446/220 |
| 2010/0175330 | A1 * | 7/2010 | Turcot | 52/2.11 |

* cited by examiner

*Cutaway View of Example Struts and Vertical Support*

INFLATABLE, PORTABLE CRIB

TECHNICAL FIELD

The present invention relates to portable cribs, in particular, cribs that attain a shape after being inflated by air under pressure.

BACKGROUND ART

When families travel with their infants and toddlers, many times they bring along a portable sleeping solution and play yard, such as a portable crib. However, current portable crib technologies are still too heavy and/or too large to travel easily with, or once setup are too small to be truly functional.

The current invention is travel crib that when packed, will have significantly reduced size (approximately the size of a volleyball) and weight (approximately 3 kg) relative to the current market offering, yet still set up to an equivalently large size when in use. This reduced weight and volume when packed will enable the crib to fit into carry-on luggage or a backpack, and may even be small enough that a toddler can carry it. As a result, this crib will help reduce the volume and weight with which a parent must travel. Also, many airlines now charge additional fees for checked luggage. Since this crib can fit inside a suitcase or carry-on, it is cheaper to travel on an airplane with this crib versus any existing travel crib which must be checked separately.

DISCLOSURE OF THE INVENTION

Summary of the Invention

The invention comprises several general aspects. Each of those can if desired be combined with additional features, including features disclosed and/or not disclosed herein, the resultant combinations representing more detailed optional embodiments of these aspects.

According to a first aspect of this invention, the inflatable, portable crib comprises at least one bottom most member parallel to the floor, at least one vertical member operationally connected to said bottom most member, at least three struts arranged around the perimeter of the bottom most member, and at least one horizontal member, said horizontal member (s) connecting at least two struts toward the tops of the struts, said horizontal member(s) operationally connected to said vertical member(s), wherein said vertical member(s) and said bottom most member(s) create an enclosed space; and wherein said struts and horizontal member(s) consist of an outer shell of dimensionally stable material and at least one inner bladder; and when said inner bladder(s) are inflated with air under pressure, said struts and vertical member(s) create a rigid structure for supporting said enclosed space.

The various additional features included in the various aspects and embodiments described below, even if described as embodiments drawn towards a particular type of vertical or horizontal support structure, or type or style of frame member are equally applicable to other types or styles of support structures or frame members. Additionally, the shape of the enclosed area (and the circumferential shape of the wall) is only loosely coupled to the shape of the supporting frame. Either shape can be triangular, square, rectangular, or any other polyhedral shape, or can be circular or elliptical. For example, the rigid frame could outline a hexagon, while the interior space might be circular with a single vertical wall forming a cylinder.

In certain embodiments of this first aspect, the struts: may be inclined at an angle to vertical of at least 10 degrees; may follow a curved path, wherein the curve may be a two- or three-dimensional curve; and/or may further comprise a foot member on the bottom of the strut at least a portion of which will be in contact with the floor or ground.

In one embodiment of this first aspect, the struts, horizontal member(s), bottom most member, and vertical wall (s), when packed and compressed, fill a volume no larger than 0.017, and together with related sundries, fills a volume no larger than 0.0425. In another embodiment, the struts, horizontal member(s), bottom most member, and vertical wall(s), when packed and compressed, have a weight of less than 3.2 kilograms, and together with related sundries, have a weight of less than to 4.5 kilograms.

In another embodiment, a first strut and a second strut may be integrally connected by and to a horizontal member, forming an inverted U-shaped frame. In yet another embodiment, the cross sectional area of the struts, horizontal members, and/or U-frames may be constant, or may vary. In still other embodiments, the inflatable portable crib comprises at least three U-shaped frames.

In certain embodiments, multiple horizontal members may be stacked one atop the other. In other related embodiments multiple struts can be can share a contact point to a horizontal member. The use of multiple structural members may provide increased rigidity to the structure.

In still other embodiments, a first strut providing a mostly vertical support for a horizontal member in a first direction, positioned side by side next to a second strut providing a mostly vertical support for a horizontal member in a second direction so as to comprise a vertical support, are prohibited from sliding and/or rolling against one another.

In another embodiment, the inflatable, portable crib further comprises at least one tension member, wherein said tension members(s) may be used to secure a first strut in a first location to a second strut adjacent to said first strut so as to comprise a vertical support. In various forms of this embodiment, the tension member(s) may be attachably removable, or at least a portion of at least one tension member may be permanently attached to at least one strut. In certain forms of this embodiment, multiple tension members may be attached to a single pair of struts.

In yet other forms, the tension member(s) may be positioned along the inner contact surface of two adjacent struts, or may cover at least 25% of the exposed perimeter vertical length of a set of adjacent struts.

In still other forms, a first tension member operationally attached to a first strut, may mate with a second tension member operationally attached to a second strut.

In another embodiment, the top of a horizontal section of the frame exposed to a force of at least 65N vertically downward over an arbitrary 50 mm length, may not deflect to a height of less than 460 mm when measured vertically at the location where said force is applied. In various forms, the vertically downward force may be at least 85N, or may be at least 200N.

In still other embodiments, an infant of 15 kg weight or less inside said enclosed space, exerting a force of at least 65N parallel to the plane of the ground and perpendicular to at least one of said horizontal member(s) may be incapable of lifting the side opposite said force off the ground. In various forms, the applied force may be at least 85N, or may be at least 200N.

Advantages of the Invention

The following discussion of advantages is not intended to limit the scope of the invention, nor to suggest that every form of the invention will have all of the following advantages. As will be seen from the remainder of this disclosure, the present invention provides a variety of features. These can be used in different combinations. The different combinations are referred to as embodiments. Most embodiments will not include all of the disclosed features. Some simple embodiments can include a very limited selection of these features. Those embodiments may have only one or a few of the advantages described below. Other preferred embodiments will combine more of these features, and will reflect more of the following advantages. Particularly preferred embodiments, that incorporate many of these features, will have most if not all of these advantages. Moreover, additional advantages, not disclosed herein, that are inherent in certain embodiments of the invention, will become apparent to those who practice or carefully consider the invention.

The foregoing and other objects of the invention are achieved by the apparatus and methods described herein which overcome problems inherent in travel cribs, particularly portable, inflatable travel cribs.

Current travel cribs come in two discrete types, inflatable cribs, and mechanical cribs. The mechanical cribs suffer in that their bulk and weight are disproportional to the enclosed space provided. Inflatable cribs suffer in that they fail to have the rigidity required to provide the necessary structural stability to pass relevant safety standards. Thus, the trade-off is bulk/weight vs. size vs. safety.

The present invention overcomes these deficiencies, eliminating the trade-offs, by creating a device that is rigid enough to meet the safety standards of mechanical portable cribs while providing a large play/rest area in a bundle that packs to an incredibly small size at minimal weight.

BRIEF DESCRIPTION OF THE DRAWINGS

The invention will be described in detail with reference to the accompanying drawings. Each of the figures is a schematic diagram more fully described below.

FIG. 1 is a top view; FIG. 2, a bottom view; FIG. 3, a side view; and FIG. 4, a perspective view.

FIG. 5 is a top view; FIG. 6, a bottom view; FIG. 7, a side view; and FIG. 8; a perspective view.

FIG. 13 shows a single tension member 310 forming a band to binding two U-frames 130. FIG. 14 shows a larger tension member 310 forming an enclosed sleeve for binding two U-frames 130. FIG. 15 shows multiple tension members 310 binding two U-frames 130. FIG. 16 details a set of tension members comprising at least one internal tension member 320, and one external tension member 330, positioned on two adjacent struts 110.

In FIG. 17, the load is applied vertically downward at some arbitrary point along a horizontal member (or horizontal portion of a U-frame); in FIG. 18, the load is applied laterally to the horizontal member (or horizontal portion of a U-frame).

BEST MODE FOR CARRYING OUT THE INVENTION

Figure 1:
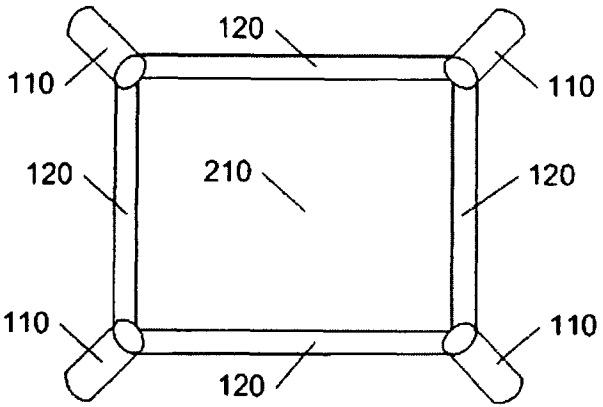
FIGS. 1-4 detail a simple embodiment of the present invention, comprising a set of vertical struts 110, horizontal members 120, a bottom most member 210, and vertical members 220.
Figure 2:
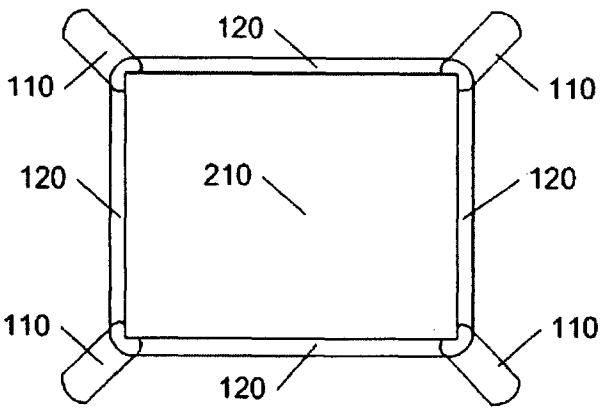
Figure 3:
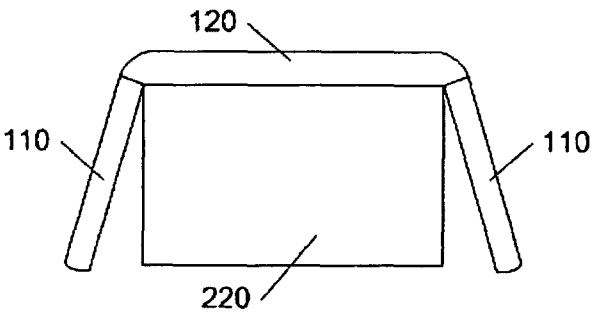
Figure 4:
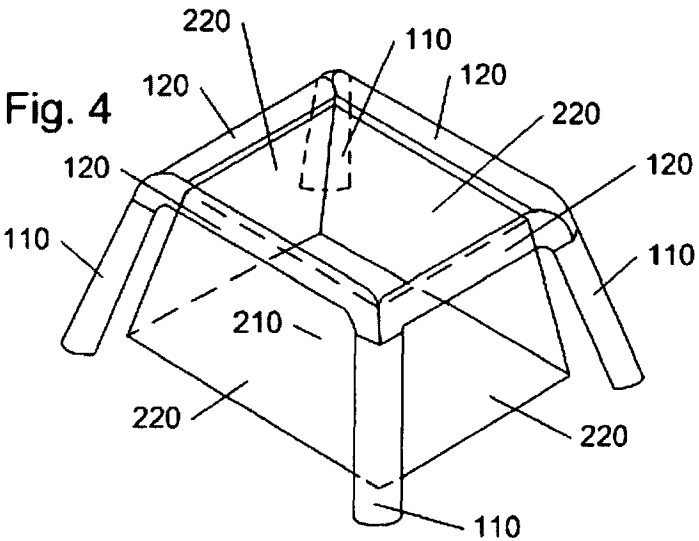
Figure 7:
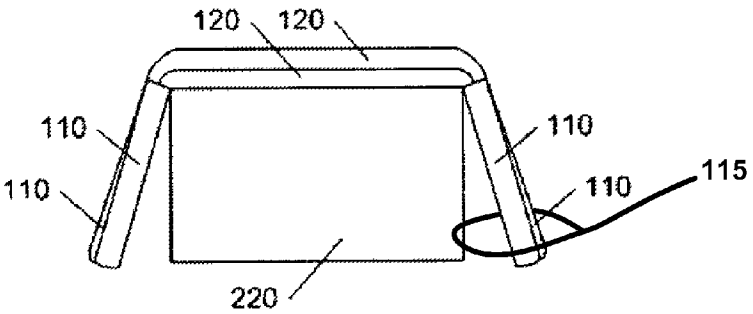
FIGS. 5-8 detail a variation on the earlier embodiment, wherein each drawing comprises of eight vertical struts 110 configured to form four vertical supports each comprising two struts, eight horizontal members 120, a single bottom most member 210, and eight vertical members 220.
Figure 8:
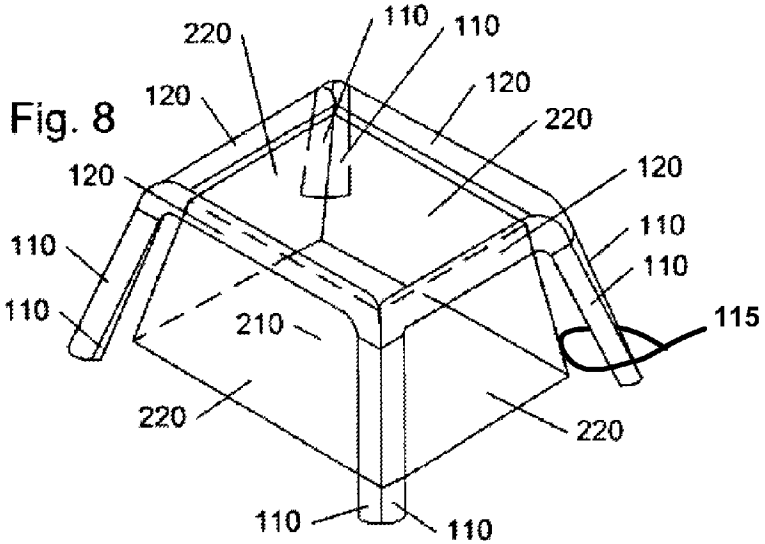
Figure 5:
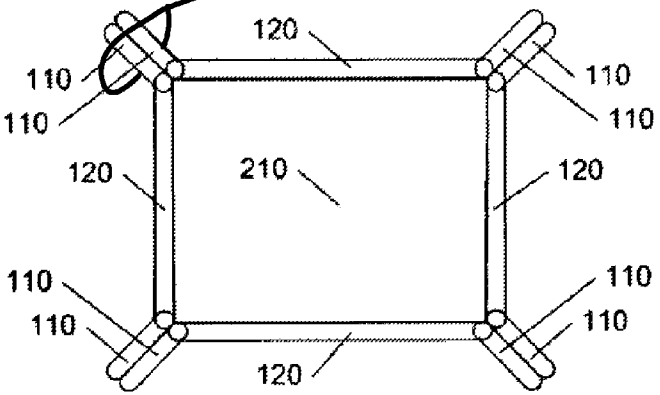
Figure 6:
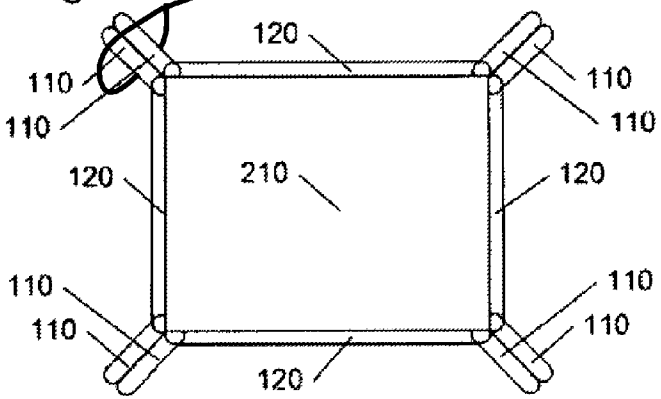
Figure 11:
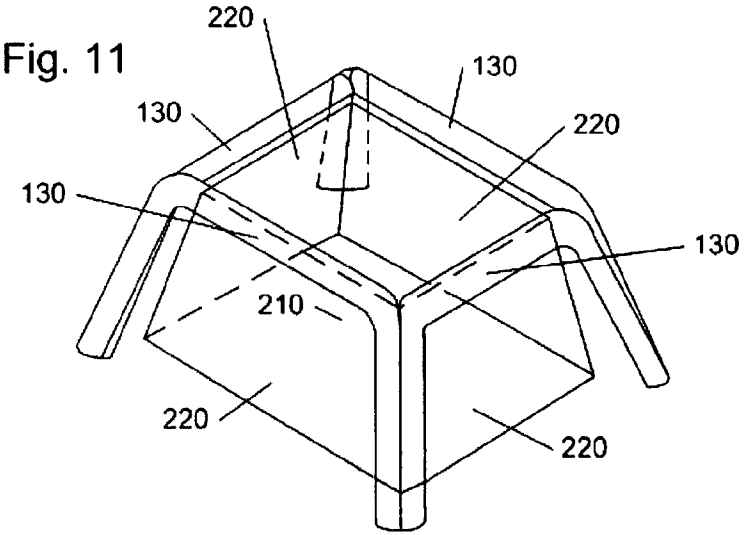
FIG. 11 is a perspective view of the invention wherein the struts and horizontal members are replaced by U-frames 130.
Figure 12:
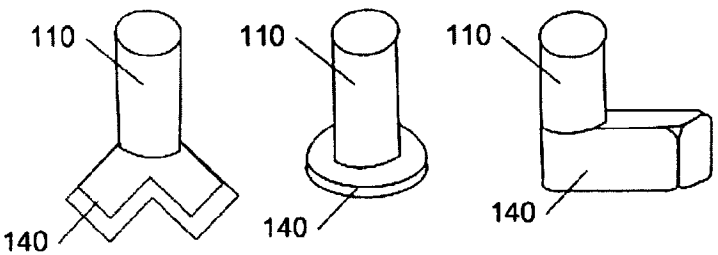
FIG. 12 shows some of the various styles of foot members 140 that can be used with the struts 110 or U-frames 130.
Figure 9:
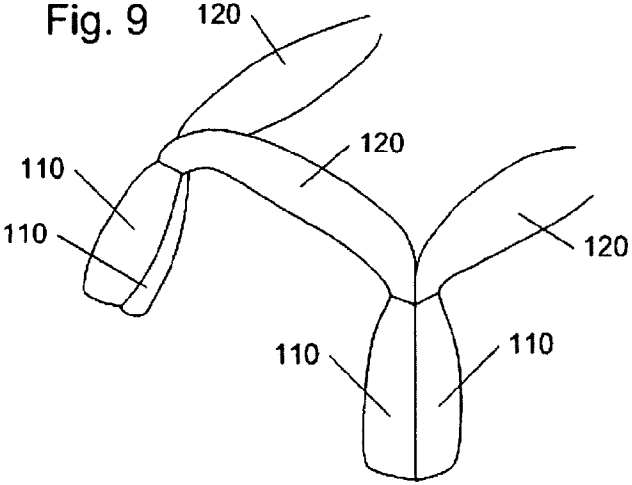
FIG. 9 is a sectional view of the invention, showing that the cross sectional area of the various struts 110 and horizontal members 120 may vary.
Figure 10:
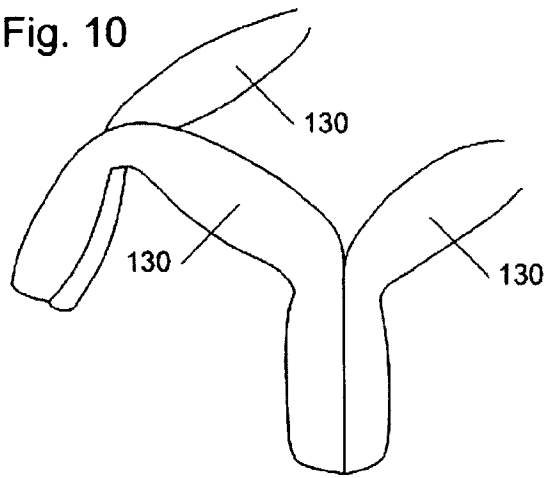
FIG. 10 is a sectional view of the invention, detailing a U-frame comprising a set of struts connected by and to a horizontal member creating a single unified piece. In this figure, the cross sectional area of the U-frame may vary.
Figure 15:
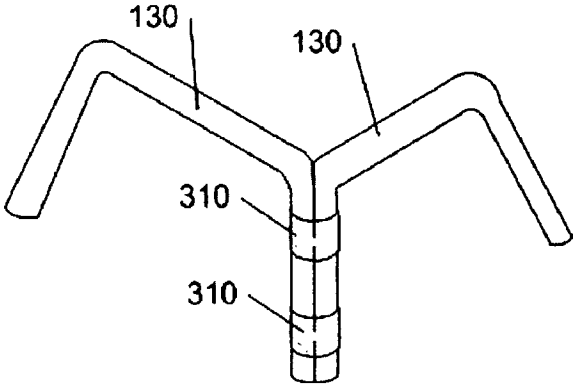
FIGS. 13-16 detail the various tension members 310 that may be used with the present invention.
Figure 16:
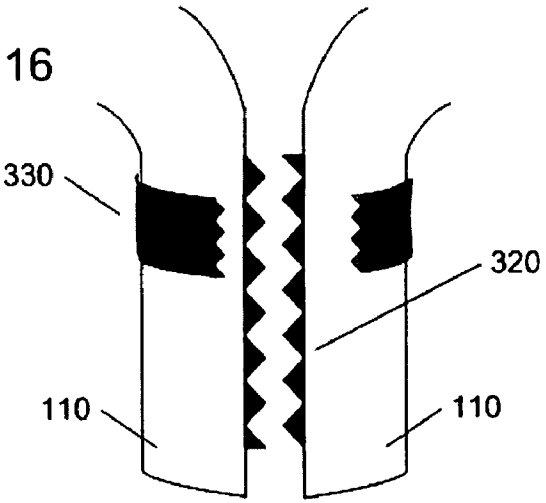
Figure 13:
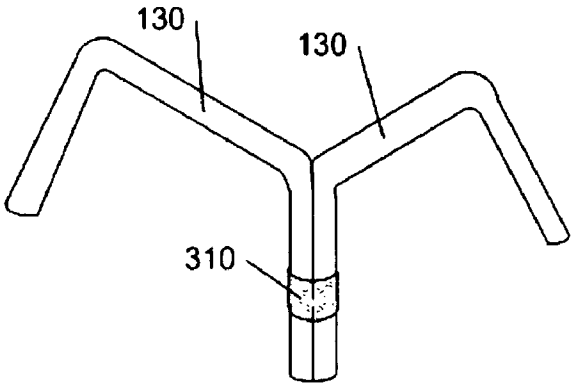
Figure 14:
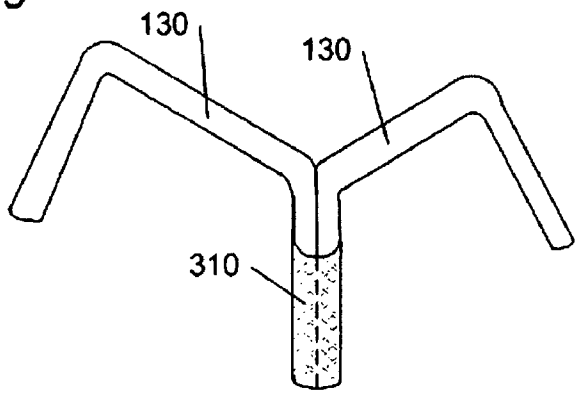

In a preferred embodiment of the present invention, the crib utilizes an internal inflated frame to give it structure and stiffness, and an integrated cover, comprising a bottom most member, and the wall(s) to create the crib area in which the infant or toddler will sleep and play.

The frame comprises a number of vertical struts 110 and horizontal members 120. In various embodiments sets of struts and horizontal members are connected into an integrated U-shaped frame 130. Each frame (or frame element) consists of a tubular textile sheath, such as sheath 1910, and an internal bladder, such as bladder 1920. The frame textile sheath is made of multiple flat pieces designed such that when they are sewn together, they create a curved, dimensionally stable, rigid structure. The frame textile may be Dacron, polyester, nylon, or other materials that can form dimensionally stable textiles.

The internal bladder, such as bladder 1920, is most commonly composed of polyurethane, but can be formed of any material which can provide a hermetically sealed bladder. The bladder, even when fully inflated, cannot provide three-dimensional rigidity. However, the combination of the internal bladder and frame sheath, such as sheath. 1910, enable the system to be inflated to a much higher pressure, i.e. 41 kPa-69 kPa (6-10 psi), than conventional inflatable crib designs which are generally 6.9 kPa-10 kPa (1-1.5 psi). This higher pressure creates a much more rigid frame. As a result, this system enables a crib to be much larger and more rigid while using a smaller volume of air and less yardage of material. This design also results in a much more compact and portable system when packed.

Various styles of rigid structures can be built from the struts 110, horizontal members 120, and/or U-frames 130 of the present invention, with the simplest being a three sided structure comprising at least three vertical struts and three horizontal members (or three U-frames). More common would be four-sided structures, although circular, elliptical, and other polyhedral shapes can be built. The area of the enclosed space and the size of the supporting structure are a trade off in terms of: the area of the bottom most member vs. the number of sides (and number of struts, horizontal members, and/or U-frames) and general dimensions of the external frame, the desired level of structural rigidity, the amount of material required to create that space, the minimum volume/weight desired in a packed configuration, and the manufacturing complexity (and associated costs) in creating that shape.

Likewise the decision on the appropriate angle for the struts (or U-frames), and the inclusion of, and the size/orientation of any foot member. The wider the stance of the struts, the more structurally stable the system. However, the wider stance will require a greater external perimeter (in addition to increasing the overall weight of the system due to the increase in material). Thus a tradeoff exists between structural stability and the area of the external perimeter with respect to the angle, if any, to which the struts are set.

Identical tradeoffs exist for the foot members. Use of a foot member (rigid or inflatable) can reduce the angle required of the struts or allow the struts to be completely vertical, and the larger the foot (and the greater its surface area) the greater the stability offered. However, the inclusion of a foot member will add complexity to the system, increase component count, manufacturing costs, and overall weight and volume.

In a preferred embodiment, the frame of the current invention consists of four independent and sealed U-frames 130 of mostly an equivalent shape such that when they are attached at the corners, they create a rigid, 3-dimensional rectangular box-like frame. Since the four U-frames 130 of the crib are independent, an air leak in one U-frame will not affect the others. As a result, the structure will stay standing even if one U-frame experiences an air leak. In fact, two adjacent U-frames of the crib would have to completely deflate for the crib to destabilize (but it would still function), and three would have to completely deflate in order for the crib to completely collapse. Additionally, constructing the crib out of four independent sides that are removably attached together is easier and more cost effective to manufacture than one contiguous frame.

While a frame assembled from four independent U-frames 130 is the preferred embodiment for the reasons stated above, this system would still work if it were constructed as one contiguous frame (i.e., four U-frames that are permanently attached at the four corners) or as two halves, each half comprising two U-frames set at 90° to one another.

Each component of the U-frame is designed so that when the individual flat pieces of the textile are assembled together (stitched, glued, welded, etc.), they create a curved three dimensional member that consists of a straight, horizontal top portion, such as portion 120, connected via curved portions, such as curved portion 1940, to straight legs that flare out at an angle to vertical. The purpose of having the legs angled by at least 10 degrees instead of being perfectly vertical is to add stability to the crib when it is assembled. This angle creates a crib footprint perimeter that is slightly larger than the perimeter around the top of the crib, creating a stable enclosure for the infant or child to play in.

In the preferred embodiment, the adjacent legs of each frame member are connected via a tension member 310 which prevents the legs from separating, and prohibits them from rolling and/or sliding against one another. In most preferred embodiments, there are at least two tension members, one along the internal contact surfaces 320 of the two legs, and one surrounding the external perimeter 330 of the two legs.

The internal tension member 320 may comprise a hook & loop system, a zipper (with one half on one leg, and the mating half on the other), or a system wherein the tension member is integrated with the legs, e.g., a dove-tail joint and socket system or some other system where one portion of one leg slots into a mating receiving portion in the other.

The external tension members 330 may be a single unit, or may comprise multiple pieces. In various preferred embodiments, at least a portion of the external tension member 330 is permanently affixed to one leg such that it can form a belt or strap, which when connected to itself encloses both legs. The mechanical interface of the connection can be via snaps, buttons, hook & loop fasteners, zippers, etc.

In various embodiments, the vertical wall(s) 220 and bottom most member(s) 210 are integrated into a single unit. In certain other embodiments, this single unit is fashioned such that there is a portion internal to the frame (forming the enclosed space for the infant), and an external portion which covers the frame, binding the enclosed space to the frame. In some forms, the external portion may create enclosed pocket within which the legs of the frame are inserted, and may additionally have a removable connector through which each pocket/leg section may be connected along the floor to the bottom most member 210. This combination of pockets and the connectors secure the crib cover to the crib frame.

While a removable connector connecting the pocket/leg section to the bottom most member is the preferred embodiment since it allows the cover to be removed for washing, a permanent fastener could be used here as well, such as stitching. The frames can also have some mechanical fastener along their length that help secure the legs in the pockets.

The vertical members 220 (e.g., the wall(s) of the enclosed space) on this crib are preferably made of breathable mesh to allow for airflow through the sidewalls into the crib. Additionally, one or more of the sides could be made out of opaque material so that the infant's view out of the crib is obstructed, helping prevent the infant from distractions when trying to fall asleep. In additional forms of the preferred embodiment, the crib may have connection mechanisms allowing an opaque material to be removably connected to the side wall (s).

The bottom most member(s) 210 of the crib form a mattress on which the infant may sleep or play. This can be constructed out of a foam sheet with the appropriate hardness to provide a supportive but comfortable base layer for the child. Alternatively, the mattress could simply be an inflated air mattress consisting of two sheets of heat-welded pvc and a valve, or a self-inflating mattress consisting of two sheets of polyurethane backed nylon (or similar non-breathable material) with a compressible foam mattress inside, and a nozzle to allow air to be pulled in when the foam pushes the two layers of nylon apart during unrolling.

The inflation of the inflatable frame can be accomplished using direct manual inflation, a manual pump, or an electric pump. The preferred embodiment contemplates a type of manual pump having a cylindrical 2-way piston pump that inflates on both the down stroke and the up stroke of the handle. However, any type of manual pump can be used (hand, foot, etc.) such that it achieves the desired pressure (approximately 6-10 psi). The preferred type of electric pump is a piston pump since they can generally achieve higher pressure than a fly-wheel pump. However, similar to the manual pump, any type of electric pump and any power source (AC, battery, car battery, etc.) can be used such that it achieves the proper pressure. If a pump is used, it can be a separate unit, or designed such that the pump is built into the frame.

The valve configuration on the crib can operate a number of different ways:

The preferred embodiment has a one-way valve on each inflated strut, such as valve 1930. The one-way valve has a removable plug that, upon removal, will allow the air out for deflation.

2) A first variation includes a valve with a single opening for inflation that splits internally into two one-way valves on two separate struts. This allows two struts to be inflated from a single inflation point, but then once the struts are inflated, they are isolated from each other, preventing them both from deflating from a single leak. The plugs in the two one-way valves can then be removed for deflation.

3) A second variation includes two valves on each strut with tubing to link multiple struts together in series. One valve is inflated, and air travels through the strut to the other valve, and then through the tubing to the next strut. This allows the entire crib frame to be inflated from one inflation point while securing each section independent of one another.

With respect to safety, the current invention can meet or surpass the safety requirements for portable, mechanical cribs, which is an ability never before demonstrated in an inflatable crib. A crib, especially a portable crib, needs to maintain the enclosed space so that the infant is kept secure. Thus it must be able to survive at least two types of loads or forces which might otherwise cause the crib to become unstable, or to mechanically fail in such a way as to no longer restrain the infant inside.

Figure 17:
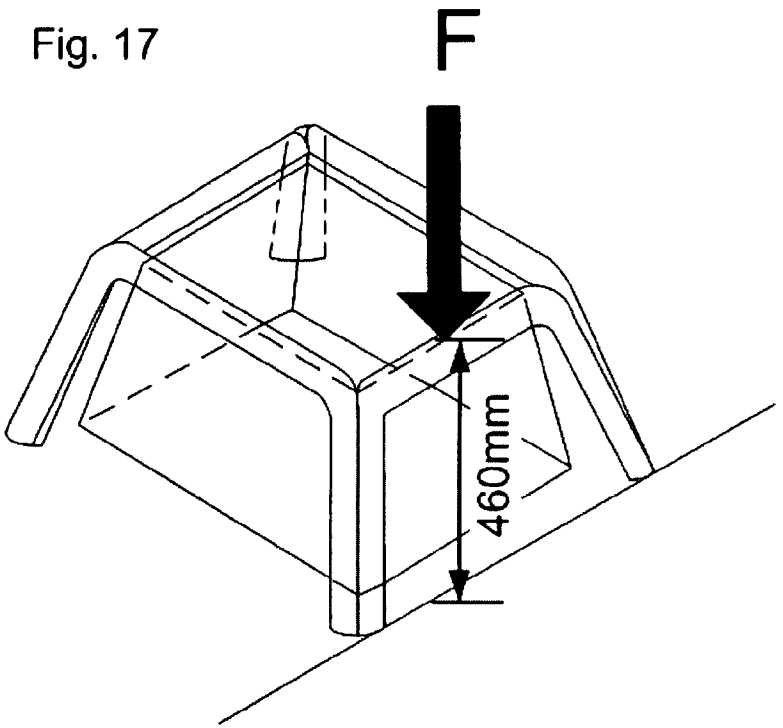
FIGS. 17 and 18 document the ability of the present invention to resist loads.

In the first instance, the crib must be able to withstand the forces inherent in a child attempting to climb over the top of the frame, or an older sibling leaning on or against the top of the frame. As shown in FIG. 17, a force, F, of at least 65N is applied vertically downward along 50 mm long horizontal section of the frame. Upon application of this load, the frame will not deflect or compress such that the top of the frame drops lower than 460 mm in height above the floor.

Figure 18:
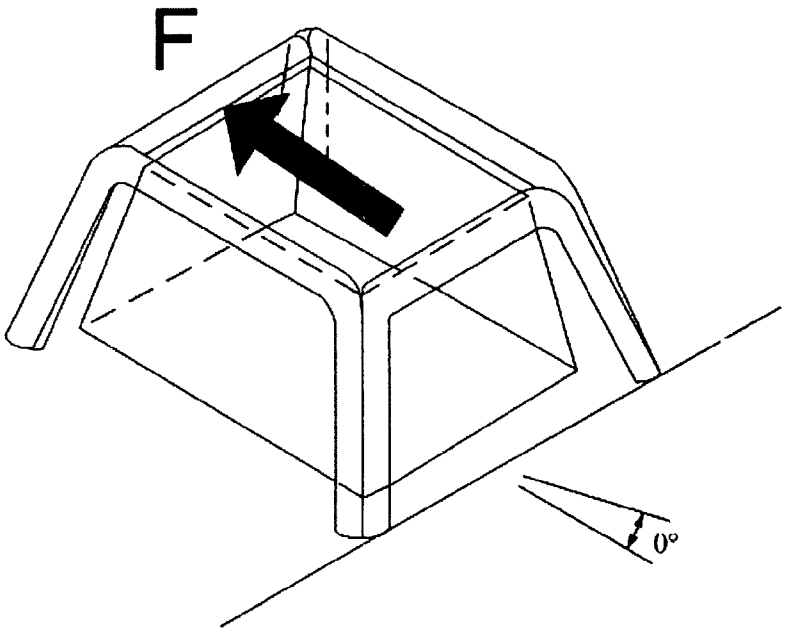
Figure 19:
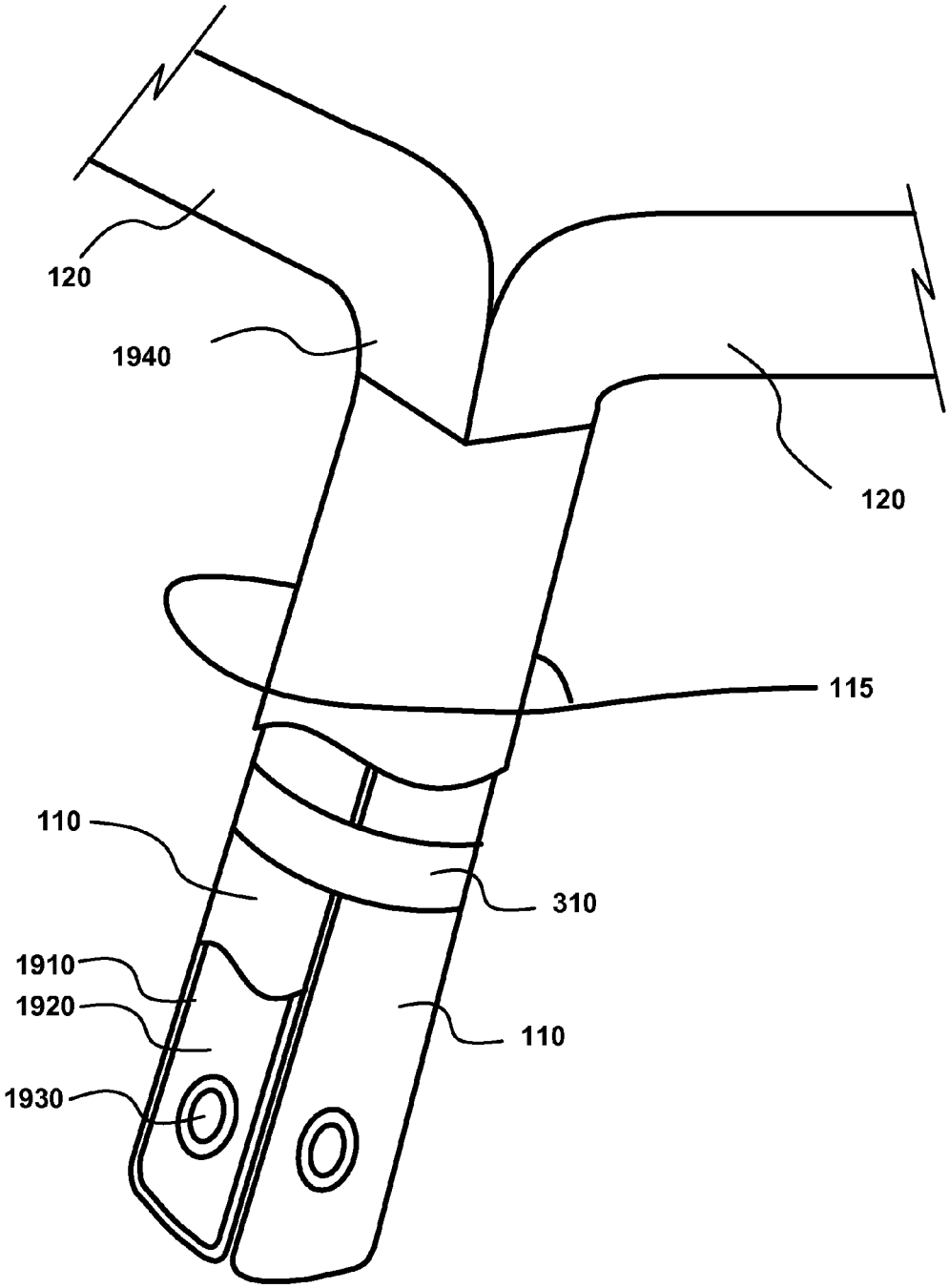
FIG. 19 illustrates details of an example strut for providing load resistance, the strut including an outer sheath and inner bladder.

In the second instance, the crib must be able to withstand the force of an infant inside the crib pushing on or running into the side walls, or pushing on or running into a horizontal section of the frame. Aside from the ability to withstand the buckling force, the crib must also maintain stability. Thus, as shown in FIG. 18, when a force, F, of at least 65N is applied parallel to the ground, but perpendicular to the horizontal section of the frame, the frame will not tip (the side of the frame opposite the application of the force will not rise off the ground).

Object Identification Numbers

TABLE 1

| | |
|---|---|
| 110 | Strut |
| 120 | Horizontal member |
| 130 | U-frame |
| 140 | Foot member |
| 210 | Bottom member |
| 220 | Side wall |
| 310 | Tension member |
| 320 | Internal tension member |
| 330 | External tension member |
| 1910 | Sheath |
| 1920 | Bladder |
| 1930 | Valve |

The invention claimed is:

1. An inflatable, portable crib, comprising:

a bottom member configured to be placed on a supporting surface;

at least one vertical member coupled to said bottom;

three or more vertical supports arranged around the perimeter of the bottom member, each vertical support including a first strut and a second strut each having a top end an a bottom end; wherein said first strut and said second strut are coupled to restrict movement between the first strut and the second strut; and one or more horizontal members;

wherein the one or more horizontal members connect at least two struts toward the top end of the struts, said horizontal member(s) operationally connected to said vertical member(s), wherein said vertical member(s) and said bottom member create an enclosed space; and wherein said struts and horizontal member(s) consist of an outer shell of dimensionally stable material and at least one inner bladder; wherein said struts and said horizontal member(s) are configured so that when said inner bladders are inflated with air under pressure, said struts and said horizontal member(s) create a rigid structure for supporting said vertical member(s) and/or said bottom member.

2. An inflatable, portable crib as in claim 1 wherein said struts are configured so as to be inclined at an angle to vertical of at least 10 degrees when the crib is positioned on a horizontal supporting surface.

3. An inflatable, portable crib as in claim 1 wherein said struts follow a curved path in the proximity of the top end.

4. An inflatable, portable crib as in claim 1 wherein said struts further comprise at least one foot member.

5. An inflatable, portable crib as in claim 1 wherein the struts, horizontal member(s), bottom most member, and at least one vertical member, when packed and compressed, fill a volume no larger than 0.017 cubic meters.

6. An inflatable, portable crib as in claim 1 wherein the struts, horizontal member(s), bottom most member, at least one vertical member, air mattress, pump, and sheet when packed and compressed, fill a volume no larger than 0.0425 cubic meters.

7. An inflatable, portable crib as in claim 1 wherein the struts, horizontal member(s), bottom most member, and at least one vertical member, have a weight of less than 3.1 kilograms.

8. An inflatable, portable crib as in claim 1 wherein the struts, horizontal member(s), bottom most member, at least one vertical member, air mattress, pump, and sheet have a weight of less than 4.5 kilograms.

9. An inflatable, portable crib as in claim 1 wherein said horizontal member(s) cross sectional area varies across a length of the horizontal member(s).

10. An inflatable, portable crib as in claim 1 wherein the cross-sectional area of the struts varies between the bottom end and the top end.

11. An inflatable, portable crib as in claim 1 wherein multiple horizontal members are stacked one atop the other.

12. An inflatable, portable crib as in claim 1 wherein a first of the three or more vertical supports and a second of the three or more vertical supports are integrally connected via a horizontal member so at to form an inverted "U" shaped frame.

13. An inflatable, portable crib as in claim 12 wherein said "U" shaped frame has a varying cross section.

14. An inflatable, portable crib as in claim 12 wherein an inflatable crib comprises a set of at least three of said "U" shaped frames.

15. An inflatable, portable crib as in claim 1 wherein the first strut of a first vertical support of the three or more vertical supports providing a vertical support for a horizontal member in a first direction, and the second strut of the first vertical support of the three or more vertical supports providing a vertical support for a horizontal member in a second direction, are positioned side by side, and wherein said struts are configured so as to prevent sliding against one another.

16. An inflatable, portable crib as in claim 1 wherein the first strut of a first vertical support of the three or more vertical supports providing a vertical support for a horizontal member in a first direction, and the second strut of the first vertical support of the three or more vertical supports providing a vertical support for a horizontal member in a second direction, are positioned side by side, and wherein said struts are configured so as to prevent rolling against one another.

17. An inflatable, portable crib as in claim 1 which further comprises at least one tension member, said tension members (s) used to secure the first strut to the second strut.

18. An inflatable, portable crib as in claim 17 wherein said tension member is attachably removable.

19. An inflatable, portable crib as in claim 17 wherein at least a portion of said tension member is permanently attached to at least one of the first and the second strut.

20. An inflatable, portable crib as in claim 17 wherein multiple tension members are attached to the first and second struts.

21. An inflatable, portable crib as in claim 17 wherein said tension member(s) cover at least 25% of the exposed perimeter vertical length of at least one of the first and the second strut.

22. An inflatable, portable crib as in claim 17 wherein said tension member(s) comprise at least one inner tension member operationally connecting the first and the second strut along an interior line of contact.

23. An inflatable, portable crib as in claim 17 wherein a first tension member operationally attached to the first strut, mates with a second tension member operationally attached to the second strut.

24. An inflatable, portable crib as in claim 1 wherein the top of a horizontal section of the frame when exposed to a force of at least 65N vertically downward over an arbitrary 50 mm length, shall not deflect to a height of less than 460 mm when measured vertically at the location where said force is applied.

25. An inflatable, portable crib as in claim 24 wherein said force is at least 85N.

26. An inflatable, portable crib as in claim 24 wherein said force is at least 220N.

27. An inflatable storage device, comprising:

three or more independently inflatable sealed U-frames, each U-frame having a pair of legs, wherein each leg is coupled to a leg of another of the four U-frames; and a bottom member coupled to the inflatable U-frames;

wherein each of the inflatable U-frames include a textile sheath enclosing an internal bladder so as to maintain an air pressure within the bladder and wherein the bladder is coupled to an inflation valve, and wherein the U-frames are configured as a curved three-dimensional member including a straight top portion connected via a curved portion to legs flared out relative to the top portion.

28. The inflatable storage device of claim 27, wherein the legs are coupled with a tension member.

29. The inflatable storage device of claim 27, wherein the legs are coupled with a plurality of tension members.

30. The storage device of claim 29, wherein the plurality of tension members includes a first tension member disposed along an internal contact surface of the legs and a second tension member disposed surrounding an external perimeter of the legs.

31. The inflatable storage device of claim 28, wherein the tension member is configured on the coupled legs to restrict sliding of the coupled legs.

32. The inflatable storage device of claim 28, wherein the tension member is configured on the coupled legs to restrict rolling of the coupled legs.

33. The storage device of claim 27, wherein the three or more independently inflatable sealed U-frames comprise four U-frames.

34. The storage device of claim 33, wherein the four U-frames are configured so as to maintain the crib in a standing position during a leak of air from one of the four U-frames when the other three U-frames are inflated.

35. The storage device of claim 27, further comprising an integrated cover, bottom member, and a plurality of walls.

36. The storage device of claim 27, wherein the textile sheath and internal bladder are configured so as to withstand an air pressure applied to the bladder of at least six pounds per square inch without bursting.

* * * * *